US005930973A

United States Patent [19]

Preece

[11] Patent Number: 5,930,973

[45] Date of Patent: Aug. 3, 1999

[54] CARPET FITTING

[76] Inventor: John William Preece, 98 Park Hall, Crescent, Castle Bromwich, Birmingham B36 9SU, United Kingdom

[21] Appl. No.: 08/930,229

[22] PCT Filed: Apr. 19, 1996

[86] PCT No.: PCT/GB96/00937

§ 371 Date: Oct. 16, 1997

§ 102(e) Date: Oct. 16, 1997

[87] PCT Pub. No.: WO96/32871

PCT Pub. Date: Oct. 24, 1996

[30] Foreign Application Priority Data

Apr. 19, 1995 [GB] United Kingdom ..... 9508196

[51] Int. Cl.[6] ..... E04F 19/04

[52] U.S. Cl. ..... 52/741.4; 52/24; 52/287.1; 52/288.1; 52/717.03; 52/717.05; 52/746.1

[58] Field of Search ..... 52/254, 287.1, 52/288.1, 717.03, 717.05, 741.4, 746.1

[56] References Cited

U.S. PATENT DOCUMENTS

| | | | |
|---|---|---|---|
| 3,092,869 | 6/1963 | Stump . | |
| 3,430,402 | 3/1969 | Gaiser . | |
| 4,114,346 | 9/1978 | Kelly . | |
| 5,481,845 | 1/1996 | Koenig, Jr. | 52/287.1 X |
| 5,584,149 | 12/1996 | Wilson | 52/287.1 X |

FOREIGN PATENT DOCUMENTS

| | | |
|---|---|---|
| 2194567 | 3/1988 | United Kingdom . |
| 2198941 | 6/1988 | United Kingdom . |
| 2237039 | 4/1991 | United Kingdom . |

*Primary Examiner*—Christopher Kent
*Attorney, Agent, or Firm*—Caesar, Rivise, Bernstein, Cohen & Pokotilow, Ltd.

[57] ABSTRACT

A flexible gasket for use in the fitting of a carpet is located between the floor and wall of a room and is of L-shape in section comprising a base limb to be connected to floor and a vertical limb extending at least to the height of the carpet.

8 Claims, 1 Drawing Sheet

CARPET FITTING

Figure 1:
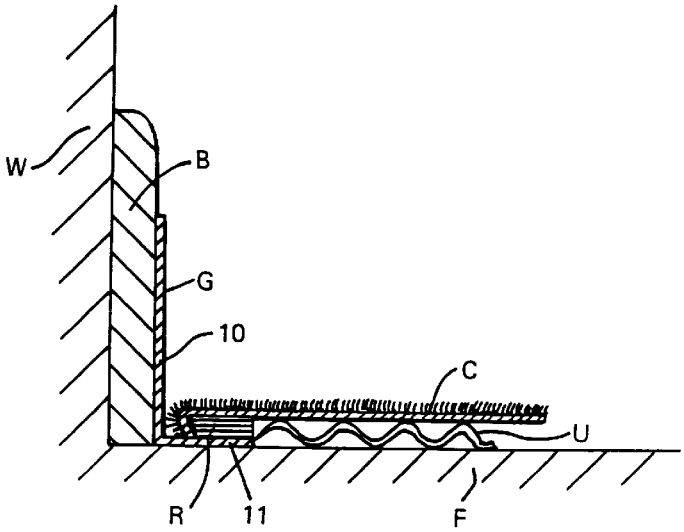

The invention relates to the fitting of carpets and in particular to the prevention of soiling at the perimeter of a fitted carpet. While the invention is applicable to the fitting of any carpet in any room of a domestic or multi-purpose building it is seen to particularly good advantage in the case of carpets of lighter colours especially on floors composed of wooden floorboards.

It is necessary to allow a draught of air under wooden floor boards. The air invades the room through the gap present between the floor and the wall skirting board. When the carpet is close fitted the passage of air is restricted but not avoided. As a consequence of the air movement dust particles present in the air are filtered by the edge of the carpet and leave a visible dirt mark along the edge. Regular vacuum cleaning around the edge of the carpet draws more air from under the edge of the carpet and accordingly increases the amount of dust filtered into the carpet. It is impossible to clean a carpet soiled in this way, and dependant on the draught and colour of the carpet can be spoiled in a short time. It is an object of this invention to provide an object to solve this problem, and a method of installing the object.

It is known from GB-A-2198941 to locate an L-shaped carpet protector in the angle between a wall and a floor of a building. The device is not intended to be urged into the corner to seal a gap.

According to the invention in one aspect there is provided a method of sealing a carpeted room against ingress of dust by closing the gap between a skirting board on a vertical wall and the wooden floor boards of the floor by placing an L-shaped flexible gasket in between the board and the carpet, characterised by engaging one limb of the gasket with the adjacent wall or floor surface, urging that section of the gasket where the two limbs connect into the gap whereby the gasket matches the perimeter contours of the room and then securing the other limb to the respective floor or wall surface.

It is an important feature of this invention that the gasket be formed of flexible material. This makes it easy to bend or fold the gasket in such a way that it can match the perimeter contours of the room caused for example, by uneven skirting board joints, curved bays, etc. (If the gasket were made of a rigid material it would not be possible to apply the gasket effectively to such areas). Preferably the gasket is formed of a sheet material such as polyethylene, having a pre-creased bend so that the gasket can be provided in roll form, and opened up will form an 'L' shaped. The vertical limb of the gasket would be applied to the skirting board, the foot or horizontal limb opened against the floor. If the polyethylene is of a low gauge then electrostatic force would be sufficient to locate the gasket against the underlying surfaces or a narrow strip of weak peel-off adhesive applied to the gasket during manufacture would suffice. The gasket is applied to the skirting board before any carpet fixing devices.

Preferably the base limb is adapted to be secured to the underlying floor when gripper fixing strips are present or adhesive is to be applied. For this latter purpose the base limb is perforated so that when adhesive is applied over the base limb (by way of trowel, spray, or adhesive tape), sufficient floor area is available through the base limb to the adhesive to allow the required bond between carpet or carpet gripper and the floor. It is an especial advantage of the invention that where the carpet has a foam backing, and is fixed with adhesive, the edge of the carpet can be uplifted from the floor along with the polyethylene which considerably reduces damage normally associated with contact adhesive installations.

The gasket of the invention provides a high degree of protection to skirting board finishes from the abrasive backing of the carpet, and the scraping action of bolster chisels, when used.

Preferably the gasket is made of an opaque material.

The height of the vertical is preferably equal to or greater than that of the carpet, typically about 20 cm. Where the height is greater than that of the carpet there will be no opportunity for dust particles to be filtered by the carpet at its edge.

Figure 2:
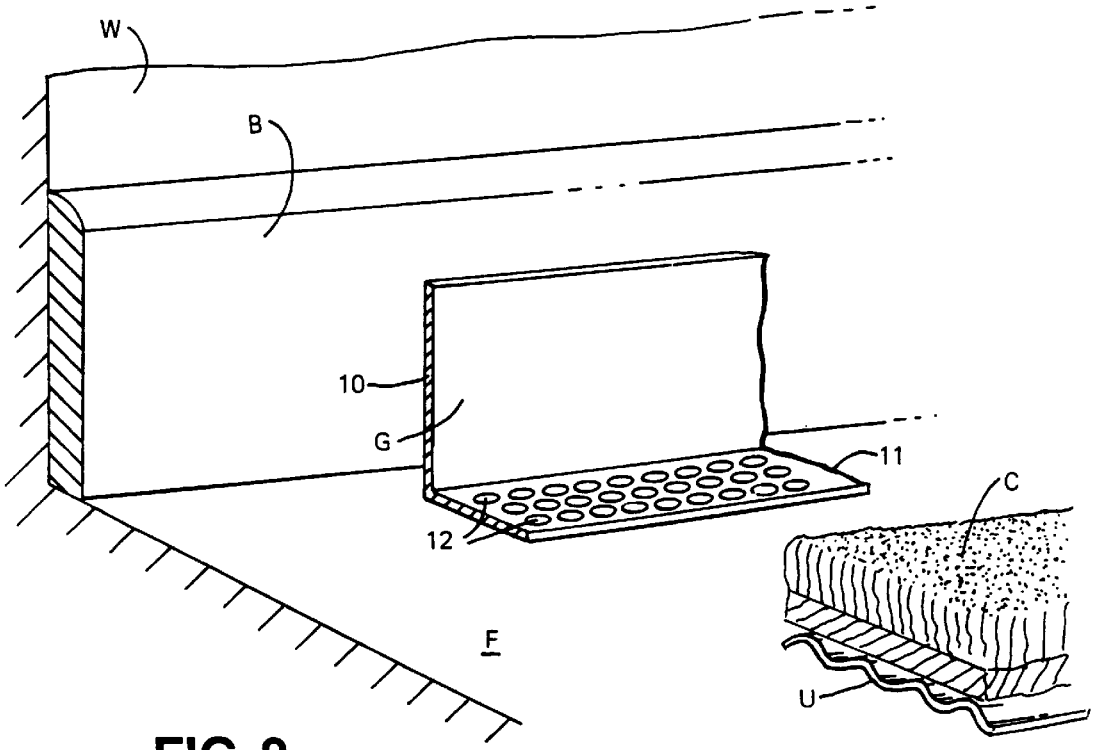

In order that the invention may be well understood it will now be described by way of example only with reference to the accompanying drawings in which:

FIG. 1 is an end elevation of a carpeted room incorporating a gasket of the invention; and FIG. 2 is an exploded perspective view of a carpeted room incorporating a gasket of the invention.

A skirting board B is typically present along the lower edge of the walls W of a room. A carpet C which may have a foam backing U is edge fitted onto a gripper fixing strip R such that the edge of the carpet is close to the skirting board B. According to the invention a gasket G is present between the board B and the carpet C and between the carpet and the gripper fixing strip present on the underlying floor F (which may be made up of floorboards).

The gasket comprises a tape or length of polyethylene or like flexible sheet material which has been bent into L-shape as seen in cross section. The gasket has a vertical limb 10 and a horizontal base limb 11, the latter having perforations 12. As shown in FIG. 1, the base has been applied on the top of the strip R and adhered thereto by adhesive. The free edge of the carpet C is then urged, e.g. chiselled into the gully between the gripper and the skirting board B. The vertical limb 10 has been contacted with the board B and is then trimmed to the height of the carpet C, so that it is not visible. Any dust which would usually be drawn up through the floor into the carpet along its perimeter is held back by the gasket G.

The gasket G may be applied in a number of ways. The vertical limb may first be placed on the board (to which it will adhere by electrostatic forces or weak peel off adhesive), the gripping strip then being applied to cover the base limb and being secured by adhesive or pins. The carpet is fitted and excess vertical limb is cut away. In another method, where foam backed carpet is to be installed, the gasket would be supplied with a weak adhesive on the underside of a perforated base limb and positioned flat on the floor. The carpet is then trimmed to the skirting board and the edge of the carpet is then lifted back to allow the uplifting of the vertical limb of the gasket. Adhesive is sprayed on and through the base perforations, and the carpet passed down into the adhesive; the vertical limb of the gasket is then trimmed.

It is simple to fit the gasket in place to function as a dust shield. The presence of the gasket helps prevent damage to the foam backing of a carpet when it is necessary to lift the carpet up. The invention is particularly effective when the carpet is of a light colour since it prevents the presence of a black mark along the edge.

I claim:

1. A method for providing sealing at the edge of a fitted carpet in a room having a skirting board, the method including:

(a) placing along the skirting board and L-shaped gasket comprising two limbs and a connecting portion between the two limbs, the L-shaped gasket being made wholly of flexible sheet material;

(b) engaging one of said two limbs with the surface of one of the floor and skirting board;

(c) urging said connecting portion of the gasket into the corner between the skirting board and floor for said connecting portion to enter into any gap that may exist between the skirting board and floor and for said gasket to follow substantially exactly the perimeter of the room; and (d) engaging the other limb of the gasket to the other of said skirting board and floor.

2. A method for providing sealing at the edge of a fitted carpet in a room having a skirting board, the method including:

(a) placing alongside the skirting board, a strip of elongate flexible sheet material having a pre-creased fold which extends along the strip and which is between first and second portions of the strip, the first and second portions extending between the fold and respective ones of two opposite lengthwise edges of the strip;

(b) adhering the first portion of the strip to the surface of the skirting board;

(c) pushing the strip in the region of the fold into the corner between the skirting board and floor so that said material tends to be pushed between the floor and skirting board;

(d) securing the second portion of the strip to the floor;

(e) laying the edge of said carpet over the second portion of the strip.

3. In a room having a suspended wooden floor and a skirting board, a method for alleviating drafts coming from under the floor and entering the room beneath the skirting board, the method including:

(a) placing along the corner between the skirting board and floor an elongate strip of flexible sheet material having a pre-creased fold along its length and having a central region which extends along the strip and containing the fold, and the strip also having first and second portions to one and the other side respectively of the central region;

(b) adhering the first portion of the strip to the skirting board;

(c) pushing the central region into said corner for said material to tend to be pushed under the skirting board;

(d) engaging the second portion of the strip with the floor;

(e) laying the edge of a fitted floor covering over said second portion.

4. A method according to claim 1 wherein the gasket is secured to the skirting board by one of electrostatic force and an adhesive.

5. A method according to claim 1 wherein the gasket is formed of a length of polyethylene.

6. A method according to claim 1, wherein the gasket comprises elongate sheet material having a pre-formed fold along its length and rolled up to form a roll of the material, the method further comprising taking a length of said material from said roll and opening it up at the fold to be of substantially L-shaped cross-section.

7. A method according to claim 1, wherein the gasket is secured to the floor by a limb having an area sufficiently large to be anchored by carpet gripper rods.

8. A method according to claim 1, in which a limb of the gasket is perforated to allow applied adhesive to pass through to an underlying floor.

* * * * *